US006614160B1

(12) United States Patent
Lee

(10) Patent No.: US 6,614,160 B1
(45) Date of Patent: Sep. 2, 2003

(54) FLUORESCENT SCREEN OF COLOR CRT AND FABRICATING METHOD THEREOF

(75) Inventor: Koo Hwa Lee, Kumi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/518,268

(22) Filed: Mar. 3, 2000

(30) Foreign Application Priority Data

Mar. 3, 1999 (KR) ..... 6882/1999

(51) Int. Cl.[7] ..... H01J 29/10
(52) U.S. Cl. ..... 313/461; 313/112; 430/27
(58) Field of Search ..... 313/461, 112, 313/466, 473, 489, 493, 408, 479, 474, 893; 430/27, 25

(56) References Cited

U.S. PATENT DOCUMENTS 5,936,339 A * 8/1999 Hayama et al. ..... 313/461
5,942,848 A * 8/1999 Van Doorn et al. ..... 313/461
5,952,776 A * 9/1999 Van Doorn et al. ..... 313/461
RE37,750 E * 6/2002 Itou et al. ..... 313/461

FOREIGN PATENT DOCUMENTS

JP 927284 A 1/1997

* cited by examiner

*Primary Examiner*—David V. Bruce
*Assistant Examiner*—Jurie Yun
(74) *Attorney, Agent, or Firm*—Birch, Stewart, Kolasch & Birch, LLP

(57) ABSTRACT

A fluorescent screen for a color CRT including: a panel having a predetermined light transmittance: a black matrix formed on the inner surface of the panel for absorbing an external light; red, green and blue fluorescent material layers positioned on the upper surface of the panel where the black matrix is formed, for emitting light corresponding to each color; a red filter layer positioned between the red fluorescent material layer and the panel, for absorbing light having wave length except for the main light emitting region of the red fluorescent material layer; and a blue filter layer positioned between the red fluorescent material layer and the panel and the green fluorescent material layer and the panel, for absorbing light having a wave length except for the main light emitting region of the green fluorescent material layer and the blue fluorescent material layer.

11 Claims, 4 Drawing Sheets

FLUORESCENT SCREEN OF COLOR CRT AND FABRICATING METHOD THEREOF

BACKGROUND OF THE INVENTION

1. Field of the Invention

The present invention relates to a fluorescent screen of a color CRT and its fabricating method, and more particularly, to a fluorescent screen structure of a color CRT which is directed to improve contrast characteristics, luminance characteristics and color purity of a screen, and to a fluorescent screen of a color CRT and its fabricating method which is capable of simplifying a fabricating process of the fluorescent screen.

2. Description of the Background Art

Generally, a color CRT is an instrument in which an electronic beam radiated from an electric gun hits a fluorescent screen formed on the inner surface of a panel, to thereby implement a picture. Recently, as the screen is being enlarged in size, it requires more improved luminance characteristics and contrast characteristics, for which research is being done.

For example, in order to obtain favorable contrast characteristics, there has been proposed that using of a dark glass of which light transmittance is approximately 36%–55% as a panel, forming a fluorescent material layer by using a fluorescent with an inorganic pigment of the same color attached on the surface of the particles thereof, or forming a three-color filter layer having the same color as that of the fluorescent material layer between the three-colored fluorescent material layer and a panel where a black matrix is formed to thereby improve a selective permeability.

However, the three methods proposed for improvement of the contrast characteristics respectively include the following disadvantages.

First, in case of the fluorescent screen of a color CRT using the dark glass as a panel, though the contrast characteristics of the screen can be improved by absorbing an external light by means of the dark glass, since the dark glass also absorbs the light emitting of the fluorescent screen, the luminance characteristics of the screen is degraded.

Secondly, in case of the color CRT in which the fluorescent material layer is formed by using a fluorescent material with pigment attached, though the contrast characteristics is improved as the attached pigment absorbs the external light, since the fluorescent material particles are overlapped to various layers to form a fluorescent screen, the light emitting of the fluorescent screen is partially absorbed to the pigment, resulting in that the luminance characteristics of the screen is degraded. In addition, since the pigment prevents electron discharged from the electron beam from colliding with the core of the fluorescent material, the luminance characteristics are degraded.

In order to solve the problem, as shown in FIG. 1, there has been o proposed a fluorescent screen where 3 color filter layer is formed which corresponds to the three-color fluorescent material layer.

FIG. 1 shows a fluorescent screen of a color CRT in which three color filter layers are formed in accordance with a conventional an.

In the drawing, the fluorescent screen has a structure in that three-color filter layers (3R, 3G and 3B) are formed on a panel 1 on which a black matrix 2 was formed, and three color fluorescent material layers (4R, 4G and 4B) are formed corresponding to the three color filter layers (3R, 3G and 36).

There are various methods of forming the three color filter layers (3R, 3G and 3B), of which two representative methods will now be described.

One method:

- A black matrix 2 is formed on the inner surface of the panel 1 of which light transmittance is approximately 70%–85% by a conventional method.
- Sensitizing solution composed of polyvinyl alcohol PVA and ammonium dichromate ADC and a filter slurry liquid mixed with pigment dispersion liquid are coated and dried on the inner surface of the panel 1 where the black matrix 2.
- The portions where each filter layer is to be formed is exposed by using a shadow mask. For example, in case of forming a green filter layer 3G, only the portion where the green filter layer 3G is to be formed is exposed to form a photoresist film, which is then developed by using water. And then, the other region except for a portion where the green filter layer 3G is to be formed is washed away, and only the green filter layer 3G remains. In order to form the red filter layer 3R or the blue filter layer 3B, the same process is repeatedly performed for the portions where each filter layer is to be formed.

Another method:

- A black matrix 2 is formed on the inner surface of the panel 1 of which light transmittance is approximately 70%~85% by a conyentional method.
- Sensitizing solution composed of polyvinyl alcohol PVA and ammonium dichromate ADC is coated and dried on the inner surface of the panel 1 where the black matrix 2.
- The portion except for the region where the green filter layer 3G is to be formed is exposed and hardened to form a photoresist film, and then a green color pigment dispersion liquid is coated and dried on the inner surface of the panel where the photoresist film was formed.
- The photoresist film is detached by etching process by using an etching solution such as aqueous hydrogen peroxide ($H_2O_2$) and developed by a strong hydraulic pressure. Then the photoresist film is removed and a green filter layer 3G is formed. In case of the red filter layer 3R and the blue filter layer 3B, the same process is repeatedly performed to thereby form filter layers.

After the three filter layers 3R, 3G and 3B are formed, on which fluorescent material layers 4R, 4G and 4B are formed corresponding to each filter layer, thereby completing a fluorescent screen structure of a color CRT having three color filter layers.

Reference numeral 5 of FIG. 1 denotes an aluminum film for preventing the electron beam from deviating backward and for rendering the light emitted in the backward direction to be reflected in the forward direction, and reference numeral 6 is a coloration film or a coloration coating layer for improving the contrast characteristics of the screen.

As mentioned above, in case that the three-color filter layers 3R, 3G and 3B are formed on the fluorescent screen of the color CRT, its contrast and luminance can be improved by 10%~20% compared to the color CRT using the fluorescent material attached by the pigment.

A Japanese Open Laid No. 9-27284 discloses that since the three-color filter layers 3R, 3G and 3B has the maximum transmittance for the light having a wave length in the range of approximate ±20 nm of the maximum light emitting wave length region of the three-color fluorescent material layers 4R, 4G and 4B corresponding to each filter layer and have relatively low transmittance for the other wave length region, the contrast characteristics of the color CRT can be improved.

Substantially, as shown in FIGS. 2A, 2B and 2C, the transmittance of each filter layer 3R, 3G and 3B for the light emitting region of the red, green and blue fluorescent material layers 4R, 4G and 4B is effective in the maximum light emitting region of each fluorescent material layer.

In case of the blue filter layer 3B, as shown in FIG. 2A, it has approximately 70% transmittance at 450 nm, that is, the maximum light emitting region of the blue fluorescent material layer 4B, while in case of the red filter layer 3R, as shown in FIG. 2B, it has approximately 60% transmittance at 625 nm, that is, the maximum light emitting region of the red fluorescent material layer 4R. Meanwhile, in case of the green filter layer 3G, as shown in FIG. 2C, it has approximately 70% transmittance at 530 nm, that is, the maximum light emitting region of the green forescent material layer 4G.

However, the conventional art has the following problems.

Though forming each filter layer for each fluorescent material layer is effective in the aspect of improving the contrast characteristics and the luminance characteristics of the color CRT, since the three filter layers need to be formed, the number of the processes is inevitably increased additionally and its productivity is degraded.

Also, equipments are required for forming each filter layer, causing an increase in the material cost which is led to an increased in a production cost.

In addition, due to the process spread according to the increase in the number of processes, the defective proportion of products is increased.

SUMMARY OF THE INVENTION

Therefore, an object of the present invention is to provide a fluorescent screen for a color CRT and its fabricating method which is capable of simplifying a structure of the fluorescent screen of the color CRT and its fabricating method.

Another object of the present invention is to provide a structure of a fluorescent screen of a color CRT and its fabricating method which is capable of improving contrast and luminance characteristics and color purity of a color CRT as well as simplifying its fabricating method without forming not all of three-color filter layers.

To achieve these and other advantages and in accordance with the purposed of the present invention, as embodied and broadly described herein, there is provided a fluorescent screen for a color CRT including a panel having a predetermined light transmittance; a black matrix formed on the inner surface of the panel for absorbing an external light; red, green and blue fluorescent material layers positioned on the upper surface of the panel where the black matrix is formed for emitting light corresponding to each color; a red filter layer positioned between the red fluorescent material layer and the panel, for absorbing light having wave length except for the main light emitting region of the red fluorescent material layer; and a blue filter layer positioned between the red fluorescent material layer and the panel and the green fluorescent material layer and the panel, for absorbing light having a wave length except for the main light emitting region of the green fluorescent material layer and the blue fluorescent material layer.

The blue filter layer has a more than 70% transmittance for a light having 450 nm wave length, that is, the main light emitting region of the blue fluorescent material layer, and has a more than 60% transmittance for a light having a 530 nm wave length, that is, the main light emitting region of the green fluorescent material layer.

Also, in order to achieve the above object, there is also provided a method for fabricating a fluorescent screen of a color CRT including the steps of: forming a black matrix, that is, an external light absorbing layer, on the upper surface of a panel having a predetermined light transmittance; coating a sensitizing solution on the upper surface of the panel where the black matrix was formed, exposing and hardening a green color portion and a blue color portion, and developing them with water to form a photoresist film; coating and drying a red color pigment dispersion liquid that a red color pigment is dispersed with water and a dispersion agent on the photoresist film, and detaching the photoresist film photosensitized with an etching solution, to form a red filter layer; coating and drying a blue color pigment dispersion liquid that a red color pigment is dispersed with water and a dispersion agent and a blue filter slurry liquid composing of a sensitizing solution on the inner surface of the panel, exposing and hardening a green portion and a blue portion, and developing them with water, to form a blue filter layer; and forming a red to fluorescent material layer on the upper surface of the red filter layer, and respectively forming a blue fluorescent material layer and a green fluorescent material layer on the upper surface of the blue filter layer positioned on the green and blue portions.

The red color pigment dispersion liquid contains ferric oxide ($Fe_2O_3$) with content of 5 wt %~20 wt %, and the blue color pigment dispersion liquid contains cobalt blue ($CoO—Al_2O_3$) with content of 5 wt %~25 wt %.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The present invention may include a plurality of embodiments and the following description is based on the most preferred embodiment. The technique of the present invention can be used for various visual display products adopting a method in which colors are implemented by light emitting of a fluorescent screen.

Figure 1:
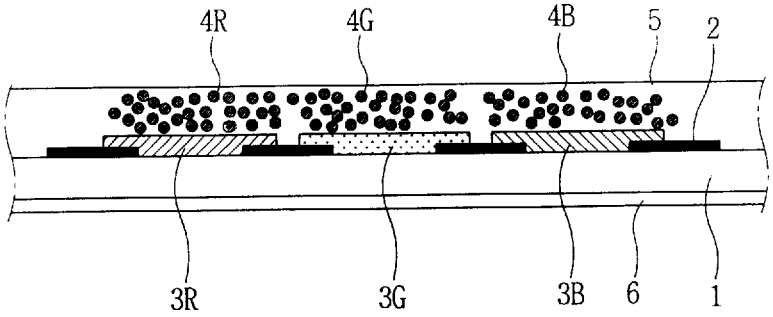
FIG. 1 CONVENTIONAL ART
FIG. 1 is a sectional view of a color CRT in accordance with a conventional art.
Figure 2A:
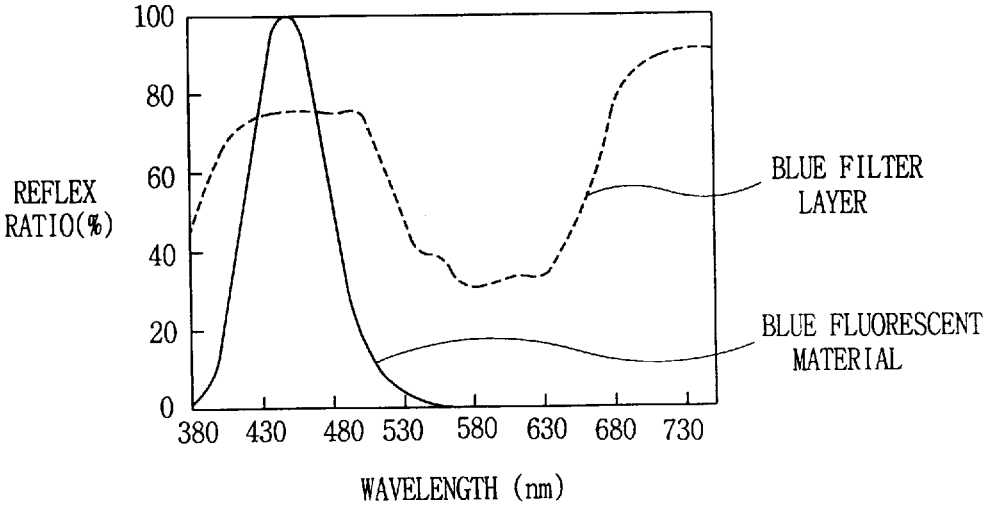
FIG. 2A CONVENTIONAL ART
FIG. 2A illustrates a permeability of a blue filter layer and a light emitting region of a blue fluorescent material layer adopted to the color CRT of FIG. 1 in accordance with the conventional art.
Figure 2B:
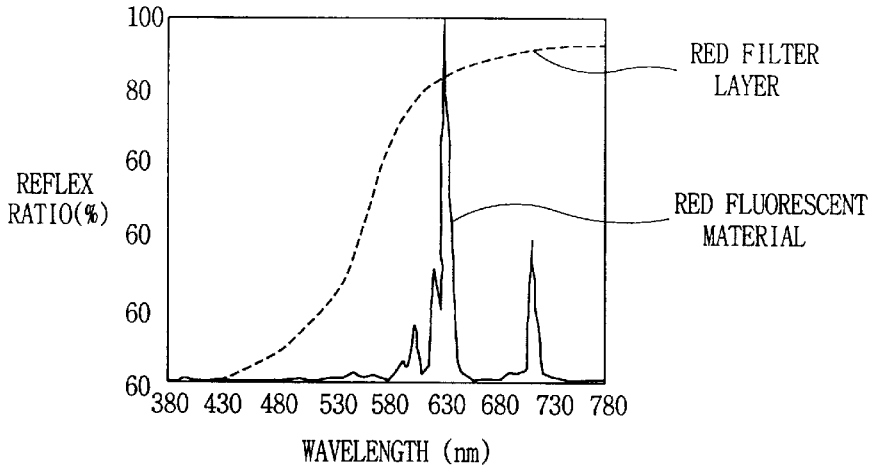
FIG. 2B CONVENTIONAL ART
FIG. 2B illustrates a permeability of a red filter layer and a light emitting region of a red fluorescent material layer adopted to the color CRT of FIG. 1 in accordance with the conventional art.
Figure 2C:
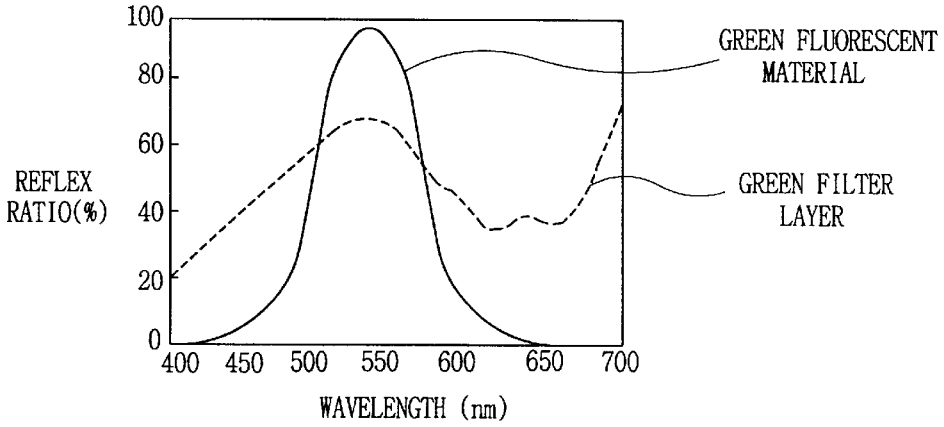
FIG. 2C CONVENTIONAL ART
FIG. 2C illustrates a permeability of a green filter layer and a light emitting region of a green fluorescent material layer adopted to the color CRT of FIG. 1 in accordance with the conventional art.

FIGS. 2A through 2C show light emitting region of each fluorescent material layer and permeability of each filter layer in a fluorescent screen structure of a color CRT having three color filter layers 3R, 3G and 3B in accordance with the conventional art.

Figure 3:
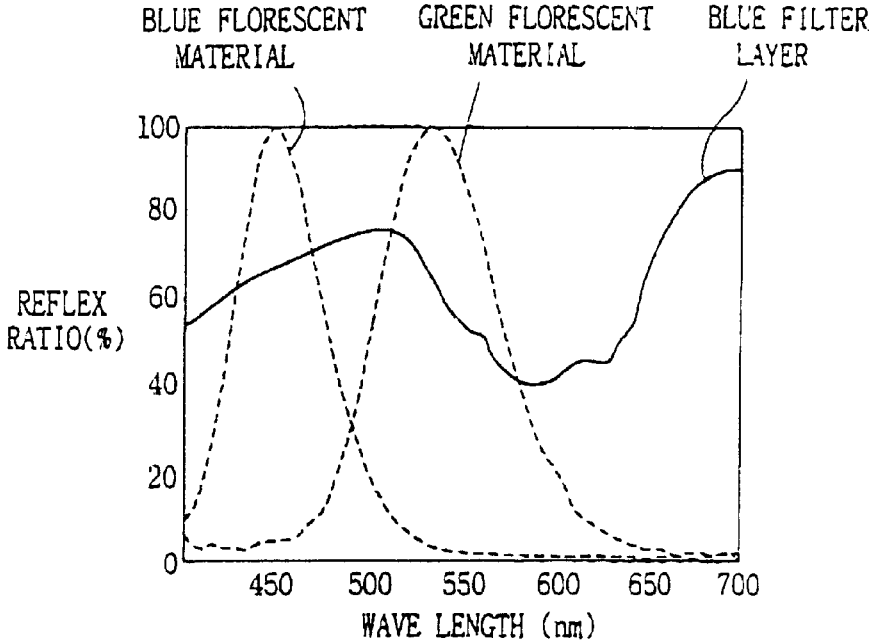
FIG. 3 illustrates a permeability of a blue filter layer and light emitting regions of a blue fluorescent material layer and a green fluorescent material layer of a color CRT in accordance with the present invention.

FIG. 3 illustrates the light emitting region of a blue fluorescent material layer 48, the light emitting region of a green fluorescent material layer 4G and a transmittance of a blue filter layer 4B of the fluorescent screen of the color CRT in accordance with the present invention.

The blue filter layer 3B as shown in FIG. 3 has more than 70% transmittance at 450 nm, that is, the maximum light emitting region of the blue fluorescent material layer 48 and has more than 60% transmittance at 530 nm, that is the maximum light emitting region of the green fluorescent material layer 4G.

The present invention utilizes such characteristics of the blue filter layer 3B in a manner that the function of the green filter layer 3G is replaced by the blue filter layer 3B so that the three filter layers in the conventional art are reduced to two layers in number.

That is, the red filter layer 3R is formed on a position where the red fluorescent material layer 4R is to be formed of the inner surface of the panel where the black matrix 2 was formed, and the blue filter layer 3B is formed on a position where the green fluorescent material layer 4G and the blue fluorescent material layer 4B are to be formed.

The present invention will now be described in detail with reference to FIGS. 3 through 4C.

First, the method for forming the red filter layer 3R is as follows.

Figure 4A:
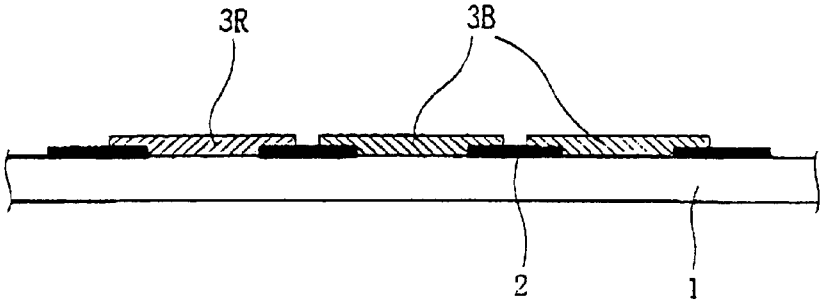
FIG. 4A illustrates a process of forming a fluorescent screen of the color CRT, showing formation of a red filter layer and the blue filter layer in accordance with the present invention.

As shown in FIG. 4A, a sensitizing solution composed of polyvinyl alcohol (PVA) and ammonium dichromate (ADC) or sodium dichromate (SDC) is coated and dried, of which the portions where the green fluorescent material layer 4G and the blue fluorescent material layer 4B are to be formed are exposed on ultraviolet rays and developed with water, so that only the exposed portions remain to form photoresist film Thereafter, the red color pigment dispersion liquid composed of micro-particle ferric oxide ($Fe_2O_3$) of the red color pigment, water and dispersion agent is coated and dried on the inner surface of the panel. And then, the photosensitized photoresist film is detached by using the etching solution composed of such as aqueous hydrogen peroxide ($H_2O_2$) or ammonia ($NH_4OH$). And, when the photoresist film is developed with a strong hydraulic pressure, the red filter layer 3R is formed.

Next, the method of forming the blue filter layer 3B is as follows.

The blue filter slurry liquid is coated and dried on the inner surface of the panel where the red filter layer 3R was formed.

The blue filter slurry liquid is composed of the blue color pigment dispersion liquid consisting of micro-particle cobalt blue ($CoO—Al_2O_3$) of the blue color pigment, water and dispersion agent, and a sensitizing solution such as is sodium dichromate (SDC) or ammonium dichromate (ADC).

After the blue filter slurry liquid is dried, the portions where the blue fluorescent material layer 4B and the green fluorescent material layer 4G are to be formed are exposed on ultraviolet rays to be hardened. Thereafter, when the portions are developed with water, the blue filter layer 3B is formed on the portions where the green and blue fluorescent material layers 4G and 4B are to be formed.

The permeability of the filter layer used for the fluorescent screen of the color CRT is determined by various factors. That is, the permeability of the filter layer is determined by kinds of pigment used for the formation of the filter layer, the content of the pigment contained in the slurry liquid, and the thickness of the filter layer.

The appropriate content of the ferric oxide ($Fe_2O_3$) added to the red color pigment dispersion liquid is 5 wt %~20 wt %. The reason for this is that if the concentration of the ferric oxide ($Fe_2O_3$) is below 5 wt %, the permeability of the red filter layer 3R is weak, degrading the selective permeability, while if the concentration of ferric oxide ($Fe_2O_3$) is more than 20 wt %, it is difficult to disperse the micro-particle pigment. Also, since the permeability of the red filter layer 3R is too strong, even through the selective permeability is improved, its luminance characteristics are much degraded.

In addition, since the red color pigment dispersion liquid does not contain a polymer material that facilitates forming of film such as polyvinyl alcohol (PVA), in case that the concentration of ferric oxide ($Fe_2O_3$) is more than 20 wt %, there is a high possibility that a mottle is formed during a spin-coating.

The concentration of cobalt blue ($CoO—Al_2O_3$) is preferably 5 wt %~25 wt %. If the concentration of the cobalt blue ($CoO—Al_2O_3$) is below 5 wt %, since the filter permeability of the blue filter layer is weak, a desired selective permeability may not be obtained, while if the concentration of the cobalt blue ($CoO—Al_2O_3$) is more than 25 wt %, since the micro-particle pigment is hardly dispersed and the filter permeability is too strong, even through the selective permeability can be improved, its luminance is much degraded.

The blue filter layer 3B is formed to have the thickness of 1.0~1.5 $\mu$m.

It is desirable to use ferric oxide ($Fe_2O_3$) added to the red color pigment dispersion liquid and cobalt blue ($CoO—Al_2O_3$) added to the blue color pigment dispersion liquid, each having a particle diameter of less than 100 nm. If the particle diameter of the pigment is more than 100 nm, since the particle is too big, it is difficult to form a clean filter layer. Also, since the surface of the filter layer becomes rough, the selective permeability of the filter layer is degraded.

As mentioned above, after the red filter layer 3R and the blue filter layer 3B are formed, the red fluorescent material layer 4R is formed on the red filter layer 3R and the blue fluorescent material layer 4B and the green fluorescent material layer 4G are formed on the blue filter layer 3B by using the three-color fluorescent material according to the general method.

The fluorescent material in use for the red fluorescent material layer 4R, the blue fluorescent material layer 4B and the green fluorescent material layer 4G does not include a pigment in view of improving the luminance characteristics.

By forming the fluorescent screen of the color CRT in that manner, the number of the filter layers is reduced, so that the number of processes required for formation of the fluorescent screen can be reduced, and furthermore, the blue filter layer 3B can be obtained having an average transmittance of more than 60% for all of the light having a wave length of 450 nm which is the main light emitting region of the blue fluorescent material layer 4B and the light having a wave length of 530 nm which is the main light emitting region of the green fluorescent material layer 4G.

In addition, since the blue filter layer 3B of the present invention has a high light transmittance for a short wave-length region compared to the green filter layer 3G, the light emitting color of the green fluorescent material layer 4G passed through the blue filter layer 3B is moved to the short wave-length region, so that a higher color purity of green color can be obtained.

Also, since the blue filter layer 3B of the present invention has a high light absorptivity (that is, the transmittance is low), the external light reflection on the screen due to the external light is reduced, so that the contrast characteristics and the luminance characteristics of the screen can be improved.

The panel 1, where each filter layer and each fluorescent material are formed, preferably has a transmittance of 45%~85%. If the light transmittance of the panel 1 is below 45%, even though the contrast characteristics can be highly improved, its luminance is seriously degraded, while if the light transmittance of the panel 1 is more than 85%, since the transmittance of the panel is quite high, the luminance characteristics can be considerably improved but the contrast characteristics is much degraded.

In this respect, in case that the transmittance of the panel 1 is too high, in order to lessen the transmittance, a method may be proposed in which the outer surface of the panel 1 is color-coated or a colored film is attached onto the outer surface of the panel 1. That is, by forming a colored coating layer or a colored film 6 on the outer surface of the panel 1, an appropriate contrast characteristics can be implemented.

The colored coating layer is to be formed to have a low transmittance, and a uniform colored coating layer or uniform colored film 6 should be formed without remaining any smudge after coating.

Figure 4B:
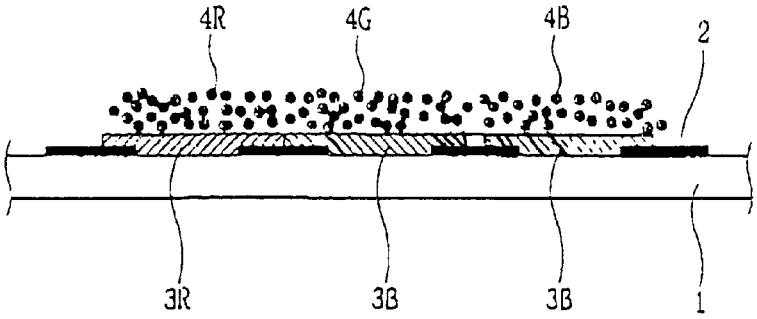
FIG. 4B illustrates a process of forming a fluorescent screen of the color CRT, showing formation of three-color fluorescent material layer in accordance with the present invention.
Figure 4C:
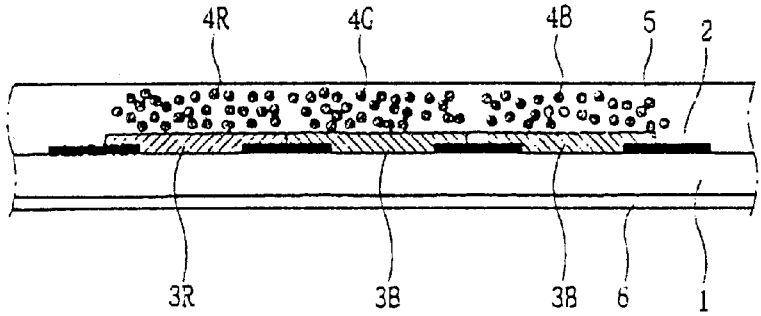
FIG. 4C illustrates a process of forming a fluorescent screen of the color CRT, showing completion of the fluorescent screen in accordance with the present invention

As shown in FIG. 4B, after the three-color fluorescent material layer is formed, an aluminum film 5 is deposited thereon as shown in FIG. 4C, which is to prevent the electron beam from deviating backwardly.

Below table 1 shows comparison of characteristics of the color CRT of the present invention, a conventional CRT 1 and a conventional CRT 2, under the condition that luminance characteristics, the contrast characteristics and color reproducibility of the conventional CRT 1 is regarded as 100.

TABLE 1

| | Conventional CRT 1 | Conventional CRT 2 | Color CRT of present invention |
|---|---|---|---|
| Color reproducibility | 100 | 107 | 110 |

TABLE 1-continued

| | Conventional CRT 1 | Conventional CRT 2 | Color CRT of present invention |
|---|---|---|---|
| Luminance | 100 | 120 | 120 |
| Contrast ratio | 100 | 100 | 100 |

Construction of the color CRT of the present invention as shown in Table 1 is as follows.

After the red filter layer 3R is formed on the inner surface of the panel 1, where the black matrix 2 was formed, by using the red color pigment dispersion liquid including 8 wt % red color pigment, and the blue filter layer 3B is formed by using the blue color filter slurry liquid including 10 wt % blue color pigment, on which three-color fluorescent material layers 4R, 4G and 4B of red, green and blue are formed by using a fluorescent material without any pigment attached, thereby fabricating the CRT. And, the colored coating layer 6 is formed on the outer surface of the panel. The blue filter layer 3B has the thickness of 1.0 $\mu$m~1.5 $\mu$m, and the pigment used for the formation of each filter has a particle diameter of less than 100 nm.

The conventional CRT 1 of Table 1 refers to a CRT using the fluorescent material with a pigment attached for constructing the fluorescent material layer, without any filter layer. The conventional CRT 2 of Table 2 refers to a CRT having three color filter layers corresponding to the three-color fluorescent material layers.

As the Table 1 shows, with the structure of the fluorescent screen of the color CRT in accordance with the present invention, the luminance characteristics is notably improved by 20% on the basis of the same contrast ratio compared to the conventional CRT 1, and since the color reproducibility is high, a screen having an excellent color purity can be implemented.

Also, as shown in the Table 1, In comparison with the conventional CRT 2, it is noted that the color CRT of the present invention is the same as or superior to the conventional CRT 2.

As so far described, having almost the same level of the luminance and the contrast characteristics of the screen compared to the fluorescent screen structure including three filter layers of the conventional art, the fluorescent screen structure according to the present invention has the high light transmittance in the short wave-length region compared to the blue filter layer 3B and the green filter layer 3G, so that the main wave length region of the green color light emitting color is moved to the short wave-length region by the blue filter layer 3B, thereby obtaining a high-degree green color purity.

Also, by using the fluorescent material without pigment, a higher luminance characteristics can be obtained.

In addition, since the filter layers to be formed are reduced in number, the process of fabricating the fluorescent screen is simplified, according to which the production cost is reduced with the effect of improvement in the productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A fluorescent screen for a color CRT comprising:

a panel having a predetermined light transmittance;

a black matrix formed on the inner surface of the panel for absorbing an external light;

red, green and blue fluorescent material layers positioned on the upper surface of the panel where the black matrix is formed, for emitting light corresponding to each color;

a red filter layer positioned between the red fluorescent material layer and the panel, for absorbing light having wave length except for the main light emitting region of the red fluorescent material layer; and a blue filter layer positioned between the blue fluorescent material layer and the panel and the green fluorescent material layer and the panel, for absorbing light having a wave length except for the main light emitting region of the green fluorescent material layer and the blue fluorescent material layer.

2. The fluorescent screen according to claim 1, wherein the blue filter layer has more than 70% transmittance for a light having 450 nm wave length, that is, the main light emitting region of the blue fluorescent material layer, and has a more than 60% transmittance for a light having a 530 nm wave length, that is, the main light emitting region of the green fluorescent material layer.

3. The fluorescent screen according to claim 2, wherein the blue filter layer is formed by using a blue color pigment dispersion liquid including cobalt blue ($CoO—Al_2O_3$) with content of 5 wt %–25 wt %, having the thickness of 1.0–1.5 $\mu$m.

4. The fluorescent screen according to claim 1, wherein the red filter layer has a more than 60% transmittance for a light having a 625 nm wave length, that is, the main light emitting wave length of the red fluorescent material layer.

5. The fluorescent screen according to claim 4, wherein a particle diameter of the cobalt blue ($CoO—Al_2O_3$) contained in the blue color pigment dispersion liquid is below 100 nm.

6. The fluorescent screen according to claim 5, wherein the particle diameter of the ferric oxide ($Fe_2O_3$) contained in the red color pigment dispersion liquid is below 100 nm.

7. The fluorescent screen according to claim 1, wherein the blue filter layer is formed by using a blue color pigment dispersion liquid including cobalt blue (CoO—Al2O3) with content of 5 wt %~25 wt %, having the thickness of 1.0~1.5 $\mu$m.

8. The fluorescent screen according to claim 1, wherein the red filter layer is formed by using a red color pigment dispersion liquid including ferric oxide ($Fe_2O_3$) with the content of 5 wt %~20 wt %.

9. The fluorescent screen according to claim 1, wherein the red fluorescent material layer and the blue fluorescent material layer are formed by using a fluorescent material without a pigment attached.

10. The fluorescent screen according to claim 1, wherein a colored coating layer or a colored film is formed on one side of the panel.

11. The fluorescent screen according to claim 1, wherein a light transmittance of the panel is 45%~85%.

* * * * *